US005679917A

United States Patent [19]

Bitsakis et al.

[11] Patent Number: 5,679,917

[45] Date of Patent: Oct. 21, 1997

[54] BREECH PLUG SUPPORT MECHANISM

[75] Inventors: Nicholas Bitsakis, Portsmouth; George M. Duarte, Saunderstown, both of R.I.

[73] Assignee: The United States of America as represented by the Secretary of the Navy, Washington, D.C.

[21] Appl. No.: 706,592

[22] Filed: Sep. 5, 1996

[51] Int. Cl.[6] ..... F41A 3/30

[52] U.S. Cl. ..... 89/20.2; 42/32

[58] Field of Search ..... 89/19, 20.2, 20.4; 82/21; 42/32, 33

[56] References Cited

U.S. PATENT DOCUMENTS

| | | | |
|---|---|---|---|
| 388,576 | 8/1888 | Nordenfelt | 89/21 |
| 772,345 | 10/1904 | Emery | 89/20.2 |
| 2,798,413 | 7/1957 | Fowler | 89/1.704 |

FOREIGN PATENT DOCUMENTS

| | | | |
|---|---|---|---|
| 386287 | 4/1965 | Switzerland | 89/20.2 |

*Primary Examiner*—Stephen M. Johnson

*Attorney, Agent, or Firm*—Michael J. McGowan; Robert W. Gauthier; Prithvi C. Lall

[57] ABSTRACT

A breech plug support mechanism for a launcher barrel having a removable breech plug comprising a handle connected to the plug by at least one leg means, the handle having a pivot arm connected thereto, the pivot arm including a traverse rod and arranged parallel to the barrel, at least one bracket connected to the barrel and having a rotator connected to the bracket, and wherein the traverse rod rotatably engages the rotator for rotating the plug adjacent the barrel during loading of the launcher. The traverse rod includes a stop key member for engaging a slot within the rotator to control the rotational movement of the traverse rod. Additionally, the pivot arm at the end nearest the plug includes a sleeve having a key slot which engages a key on the handle leg to maintain alignment of the plug with the locking ring therefor.

4 Claims, 1 Drawing Sheet

BREECH PLUG SUPPORT MECHANISM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention relates to a novel breech plug assembly. More particularly, the invention relates to a breech plug support mechanism for use on a ship mounted small device launcher which supports the breech plug when released from the launcher barrel during loading and allows the breech plug to be moved to a secure storage position.

2. Description of the Prior Art

Breech plugs for small device launchers on ships are used to block the breech hole in the base of the launch barrel. The breech plug is locked in place by a locking ring. Specifically, the locking ring rotates about the end of the launch barrel, the outer portion of the locking ring mates with the collar on the launch barrel in a thread and groove arrangement. The breech plug is released for reloading the launcher by turning a handle on the locking ring to a predefined angle which releases the breech plug and allows removal of the breech plug along a line co-linear with the axis of the barrel. A problem with this arrangement is that the breech plug, which is quite heavy, is supported only by a lanyard (steel cable) when it is not supported by the locking ring. When the breech plug is removed to reload the launcher, the breech plug and lanyard constitute a heavy weight on the end of a short cable. Ship movement causes the breech plug to swing, creating a risk of injury to nearby personnel. This problem is aggravated by the fact that the "swinging breech plug" condition occurs most often during reload of the launcher when personnel are expected to be nearby. If the lanyard breaks, the risk of injury is substantial.

The prior art breech plug assemblies can also damage the launcher barrel. For example, since the breech plug is swinging loose on the lanyard, the barrel hole sealing surface can be marred by nicks near the base of the barrel during the process of inserting the breech plug into the launcher barrel after reloading.

A search was conducted of the U.S. Patent Office records and the following patents are noted as being of interest: U.S. Pat. Nos. 388,576; 1,434,044; 2,237,601; 2,466,714; 2,798,413; 3,641,867 and 4,012,986. For example, U.S. Pat. No. 2,466,714 discloses a recoilless firearm including a breech block having a pivoting support mechanism in the form of a tappet housing and a hinge housing. The disclosed breech block, as with the lanyard described above, is allowed to pivot freely when removed from the barrel. This free swinging movement can be dangerous to personnel. Additionally, the prior art does not disclose a breech plug which can be removed or inserted without the possibility of damaging the barrel.

SUMMARY OF THE INVENTION

It is a general purpose and object of the invention to provide a breech plug support mechanism for supporting the breech plug of a small device launcher as the breech plug is released from the launcher barrel.

It is a further object of the invention to provide a breech plug support mechanism which allows for releasing the breech plug from the launcher barrel, conveying it safely to a storage position, and locking it in the storage position.

It is a still further object of the invention to provide a breech plug support mechanism which will enhance the operational efficiency in removing the breech plug from the launcher, reloading the launcher and reinserting the breech plug in the launcher.

It is another object of the invention to provide a breech plug support mechanism which will prevent injury to personnel loading a small device launcher by restraining the breech plug in a locked storage position while the launcher is loaded.

It is yet another object of the invention to provide a breech plug support mechanism in which the breech plug is inserted and locked in a launcher breech hole without damaging the barrel by ensuring that the breech plug is always aligned with the barrel breech hole, supported by a support means and inserted in a uniform motion.

These objects are accomplished with the present invention by providing a breech plug support mechanism which is useful for a small device launcher on board a ship and which allows the breech plug to be removed from the launcher barrel and stored in a locked position adjacent the launcher barrel when loading the launcher. The breech plug support mechanism of the invention is connected to a breech plug for engaging the breech hole of the launcher by means of a handle connected to the plug by at least one leg means. Connected to the handle is a pivot arm extending from the leg of the handle and a traverse rod connected to the pivot arm and in parallel relation to the barrel. The barrel includes two brackets having rotators connected thereto through which the traverse rod extends. The end of the pivot arm nearest the breech plug has a sleeve through which the leg member passes. The leg member has a key which mates with a slot in the sleeve of the pivot arm to prevent rotation of the breech plug. Additionally, the rotaters include a slot and stop key which allows rotation of the traverse rod to a predefined position adjacent the launcher barrel.

The barrel further includes a locking ring for locking and releasing the plug. The locking ring includes a lip having slots on the inside periphery of the ring. The plug includes ears which are maintained in alignment with the slots of the locking ring when the locking ring is in the open position. To lock the plug, the ears pass through the slots of the locking ring and the locking ring is then rotated on threads on the barrel such that the lip of the ring frictionally engages and overlies the ears of the plug to lock it in position. To release the plug, the locking ring is rotated in the opposite direction, the ears are aligned with the slots of the locking ring and the plug is then pulled away from the barrel by the plug handle. When the plug is clear of the barrel, the plug is rotated about the barrel to a storage position adjacent the barrel by means of the pivot arm and traverse rod on the rotators.

Accordingly, when reloading the launcher, the locking ring is rotated to release the breech plug. The handle of the support mechanism is pulled rearward and the key of the handle leg passes through the sleeve of the pivot arm. The key in the handle leg and the slot of the pivot arm sleeve preclude the breech plug from rotation. Once released from the launcher, the traverse rod is rotated to a storage position adjacent the launcher during reloading. The stop key of the rotator stops rotation of the traverse rod and the breech plug.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
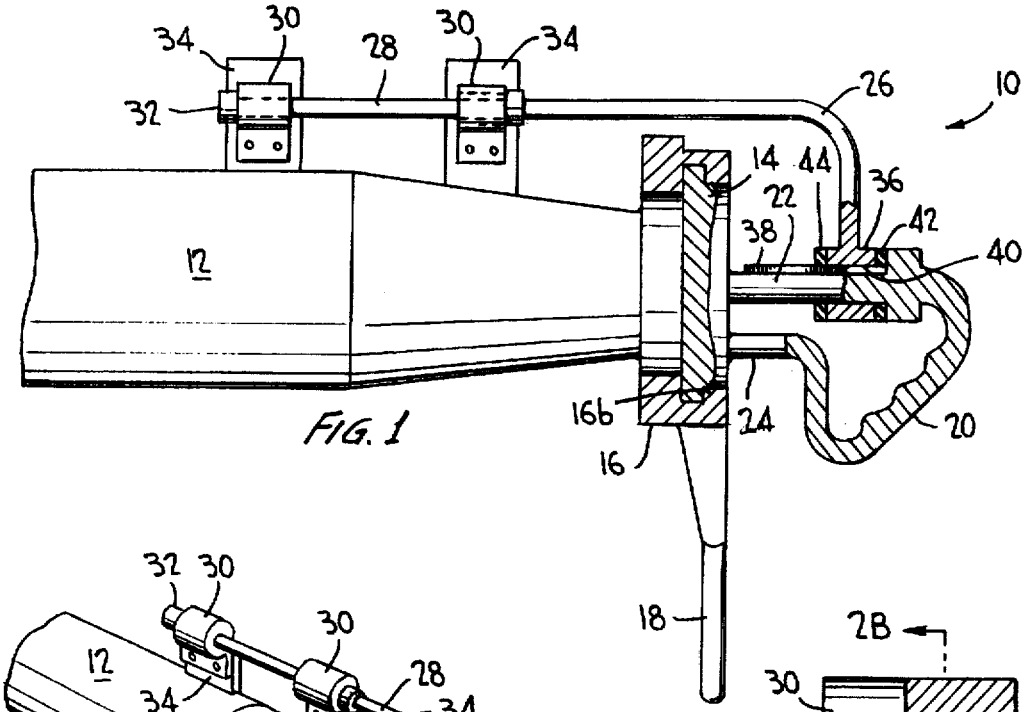
FIG. 1 is a top view partially in section of the breech plug support mechanism with the breech plug locked in the barrel of a small device launcher.

Referring now to FIG. 1, there is shown a top view of the breech plug support mechanism 10 of the invention attached to a launcher barrel 12. Breech plug 14 is locked in barrel 12 by a locking ring 16 having a handle 18. Locking ring 16 mates with the collar of the barrel 12 in a thread and groove arrangement for rotating the locking ring on the barrel to lock and release breech plug 14.

Breech plug support mechanism 10 further includes a plug handle 20 which is connected to plug 14 by leg members 22 and 241, and a pivot arm 26 which is rotatably mounted on barrel 12 by a traverse rod 28 on a pair of rotators 30. Traverse rod 28 includes a removable stop 32 which prevents rod 28 from disengagement with rotators 30. Rotators 30 are mounted to barrel 12 by brackets 34.

The end of pivot arm 26 nearest breech plug 14 has a sleeve 36 through which leg member 22 passes. Leg member 22 has a key 38 which mates with slot 40 in sleeve 36 to prevent rotation of breech plug 14. Rubber bumpers 42 and 44 extend around the periphery of each end of sleeve 36 to minimize contact vibrations when breech plug 14 is removed or inserted into barrel 12.

Figure 2:
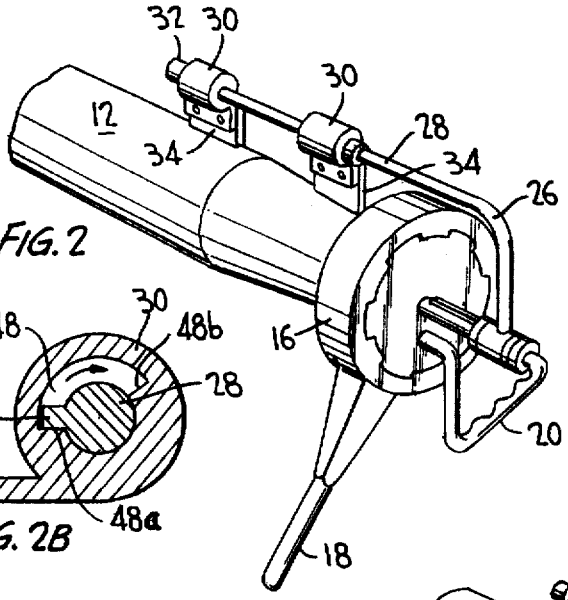
FIG. 2 is a perspective view from the end of the barrel and breech plug support mechanism of FIG. 1.
Figure 2A:
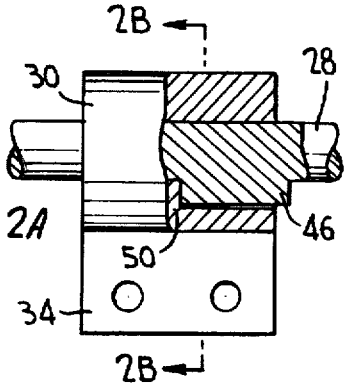
FIG. 2A is an enlarged partial sectional view of the rotator 30 of FIG. 2.
Figure 2B:
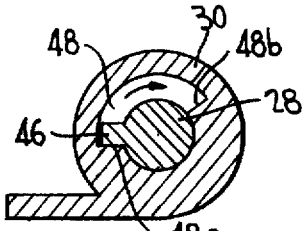
FIG. 2B is a cross sectional view along line 2B of FIG. 2A of the rotator of the present invention.

Referring additionally to FIGS. 2, 2A and 2B, there is shown at FIG. 2 a perspective view from the end of and above barrel 12. It will be appreciated that brackets 34 are in a horizontal position, but the perspective viewpoint has been rotated to better illustrate the features of the invention. FIG. 2A is an enlarged sectional view of rotator 30 of FIG. 2 and FIG. 2B is a cross-sectional view of FIG. 2A taken at line 2B and is rotated clockwise through 90° to show the horizontal orientation of rotators 30. Stop key 46 is provided on rod 28 and rotator 30 has a rotation slot 48. Stop key 46, working within rotation slot 48 limits the rotation of rod 28. Rotation slot 48 is configured such that stop key 46 rests against first shoulder 48*a* of rotation slot 48 when breech plug 14 is inserted into barrel 12. Further, stop key 46 abuts stop shoulder 50 to prevent forward movement of rod 28.

Figure 4:
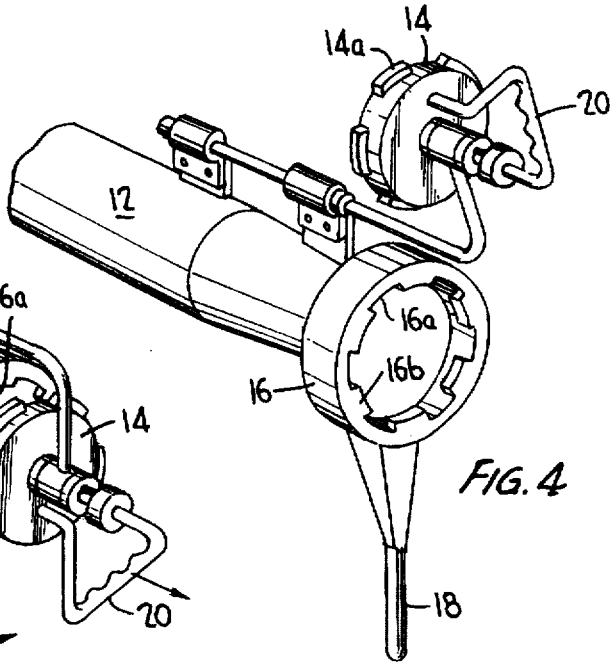
FIG. 4 is a view of the barrel as shown in FIGS. 2 and 3 with the breech plug rotated out of alignment with the barrel and secured in a storage position.
Figure 3:
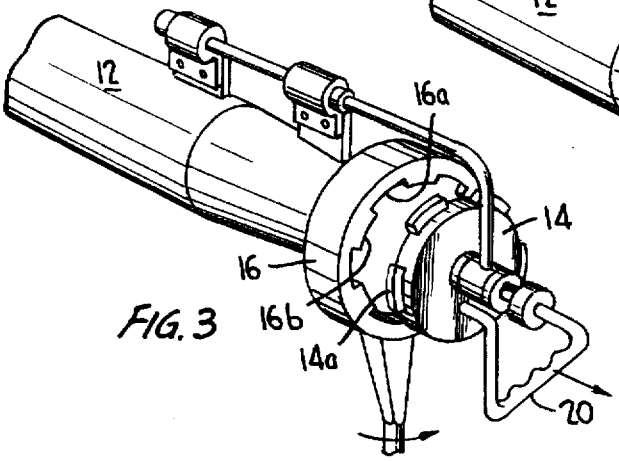
FIG. 3 is a view of the barrel substantially as shown in FIG. 2 with the locking ring rotated to the unlocked position and the breech plug released from the barrel.

Referring now additionally to FIGS. 3 and 4, plug 14 includes a plurality of ears 14*a* which align with corresponding slots 16*a* of locking ring 16 when the locking ring is rotated to release plug 14. To lock the plug 14 into the breech hole, the flocking ring 16 is rotated such that the lip 16*b* of locking ring 16 frictionally engages and overlies the ears 14*a* and thereby locks plug 14 in position on barrel 12.

A further important feature of the invention is to prevent the ears 14*a* of plug 14 from marring the locking ring 16 or the barrel 12 by keeping ears 14*a* in constant alignment with slots 16*a* while inserting plug 14 into barrel 12. The alignment is maintained by slot key 46 resting against first shoulder 48*a* and further by key 38 in slot 40. This ensures that the ears 14*a* on the plug 14 are automatically lined up with the corresponding slots 16*a* of the locking ring 16 and that no damage occurs during insertion of the breech plug into the barrel hole.

For storage, pivot arm 26 and rod 28 are rotated such that breech plug 14 is in the position (approximately at a 2 o'clock position in relation to the barrel 12) shown in FIG. 4. In this position, stop key 46 rests against second shoulder 48*b* of slot 48. The weight of breech plug 14 and its moment arm about rod 28 prevent breech plug 14 from rotation back towards the barrel.

It is also understood that the plug 14 does not need a latch holding it in the open and released position as shown in FIG. 3 because launch barrels are typically mounted at a 30 degree angle and, therefore, when the locking ring 16 is rotated to the open position, the breech plug 14 can be easily released from the barrel by handle 20 which is pulled downwardly and to an open position as shown in FIG. 3.

Referring more specifically to FIGS. 2, 3 and 4, there is shown the sequence of motions which allows the breech plug 14 to be withdrawn from the breech hole and stored in a safe predefined storage position away from the axis of the barrel. The sequence of motions is as follows. As seen in FIG. 2, the plug 14 is locked in place to barrel 12 by locking ring 16. To release to plug 14, locking ring 16 is rotated in a counter-clockwise motion by handle 18 which aligns slots 16*a* with ears 14*a*. As seen in FIG. 3, the plug 14 is pulled out by handle 20 and ears 14*a* pass through slots 16*a*. Leg member 22 slides within sleeve 36 until plug 14 contacts bumper 44. The breech plug 14 and support mechanism 10 is then rotated clockwise and adjacent the barrel 12 as shown in FIG. 4 to about the 2 o'clock position in relation to the barrel 12, being held by stop key 46 resting against second shoulder 48*b*. The launcher can then be loaded with the breech plug 14 in this position. Once loaded, the plug 14 is rotated back to the position shown in FIG. 3. Due to stop key 46 resting against first shoulder 48*a*, the slots 16*a* of the locking ring 16 and the ears 14*a* of the plug 14 are arranged such that they are in alignment. This allows insertion of the plug 14 for locking such that it will not nick or mar the locking ring 16 and the barrel hole when in inserting the plug 14.

As apparent from the above specification, the present invention provides a breech plug support mechanism which will support the breech plug when released from a launcher barrel in a secure storage position which will avoid injury to personnel. It further provides ensured alignment of the breech plug and the locking ring to provide for a simple and quick release and insertion of the breech plug and to avoid damage to the launch barrel or the locking ring. It is further understood that, while a presently preferred embodiment has been described, modification may be provided without departing from the scope of the invention. For example, a locking mechanism such as a latch means may be provided to the rotator 30 to lock the breech plug 14 in a locked storage position to ensure that the breech plug could not be swung from the storage position without removing the. locking mechanism. Additionally, in the preferred embodiment, the pivot arm 26 and traverse rod 28 rotates but does not move laterally. It is understood that the invention may be modified such that the pivot arm and traverse rod slide laterally, thereby eliminating sleeve 36 and modifying rotator 30.

In light of the above, it is therefore understood that within the scope of the following claims, the invention may be practiced otherwise than as specifically described.

What is claimed is:

1. A breech plug support means for a launcher barrel having a removable breech plug, the support means comprising:

a handle connected to said plug by at least one leg means;

said handle having a pivot arm connected thereto;

said pivot arm including a traverse rod arranged parallel to said barrel, said traverse rod having a stop key; and at least one bracket means connected to said barrel and having a rotator connected to said bracket means, the rotator having a key slot, wherein said traverse rod rotatably engages said rotator for rotating said plug to a storage position, said stop key engaging said key slot.

2. A breech plug support means according to claim 1 wherein:

said pivot arm includes a sleeve at the end nearest said breech plug;

said sleeve includes a slot for receiving a key member; and said leg means includes said key member for mating with said slot of said sleeve.

3. A breech plug support means for a launcher barrel having a removable breech plug, the support means comprising:

a handle connected to said plug by at least one leg means;

said handle having a pivot arm connected thereto;

said pivot arm including a traverse rod arranged parallel to said barrel;

said pivot arm including a sleeve at the end nearest said breech plug;

said leg means includes a key member for mating with a slot of said sleeve;

said sleeve includes a bumper at each end thereof to absorb a shock load of said breech plug and said handle contacting said sleeve; and at least one bracket means connected to said barrel and having a rotator connected to said bracket means, wherein said traverse rod rotatably engages said rotator for rotating said plug to a storage position.

4. A method of releasing and storing a breech plug while loading a launcher barrel comprising the steps of:

rotating a locking ring on said barrel to an open position;

sliding a leg of a handle connected to the breech plug through a sleeve attached to the barrel so as to move the breech plug away from the barrel in a direction along the axis of the barrel, the sleeve holding the breech plug and handle in relation to the barrel when the breech plug is released from the barrel;

rotating the sleeve, breech plug and handle about an axis offset from the axis of the barrel to a storage position; and engaging a stop on a rod attached to the sleeve and rotating with the sleeve, the rod being aligned with the offset axis, the stop preventing the sleeve, breech plug handle and rod from further rotation when placed in the storage position.

* * * * *